US006302930B1

(12) United States Patent
Lux

(10) Patent No.: US 6,302,930 B1
(45) Date of Patent: Oct. 16, 2001

(54) DURABLE NONWOVEN ABRASIVE PRODUCT

(75) Inventor: Ronald E. Lux, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/480,800

(22) Filed: Jan. 10, 2000

Related U.S. Application Data

(63) Continuation-in-part of application No. 09/401,938, filed on Sep. 23, 1999, now abandoned, which is a continuation-in-part of application No. 09/264,495, filed on Mar. 8, 1999, now abandoned, which is a continuation-in-part of application No. 09/231,263, filed on Jan. 15, 1999, now abandoned.

(51) Int. Cl.[7] ..... B24D 3/00; B24D 11/00; B24D 11/02

(52) U.S. Cl. ..... 51/298; 51/294; 51/295; 51/307; 451/526; 451/536

(58) Field of Search ..... 51/294, 295, 296, 51/297, 298, 307; 451/536, 526

(56) References Cited

U.S. PATENT DOCUMENTS

| | | | |
|---|---|---|---|
| 2,958,593 | 11/1960 | Hoover et al. | 51/297 |
| 3,260,582 | 7/1966 | Zimmer, Jr. et al. | 51/293 |
| 3,401,491 | 9/1968 | Schnabel et al. | 51/295 |
| 3,537,121 | 11/1970 | McAvoy | 15/230.12 |
| 3,686,049 | 8/1972 | Manner et al. | 156/167 |
| 3,687,759 | 8/1972 | Werner et al. | 156/167 |
| 3,691,004 | 9/1972 | Werner et al. | 161/150 |
| 3,837,988 | 9/1974 | Hennen et al. | 161/67 |
| 3,852,152 | 12/1974 | Werner et al. | 161/168 |
| 3,936,337 | 2/1976 | Stapp | 156/167 |
| 4,018,575 | 4/1977 | Davis et al. | 51/295 |
| 4,227,350 | 10/1980 | Fitzer | 51/295 |
| 4,355,489 | 10/1982 | Heyer et al. | 51/297 |
| 4,991,362 | 2/1991 | Heyer et al. | 51/295 |
| 5,282,900 | 2/1994 | McDonell et al. | 51/295 |
| 5,346,516 | 9/1994 | Alkhas et al. | 51/293 |
| 5,363,604 | 11/1994 | Heyer | 51/296 |
| 5,573,844 | 11/1996 | Donovan et al. | 51/295 |
| 5,733,825 | 3/1998 | Martin et al. | 442/361 |
| 5,811,186 | 9/1998 | Martin et al. | 428/373 |
| 5,928,070 * | 7/1999 | Lux | 51/307 |

FOREIGN PATENT DOCUMENTS

| | | | |
|---|---|---|---|
| 916 287 | 3/1982 | (SU) . | |
| WO 98/23800 | 6/1998 | (WO) | D01F/8/04 |
| WO 98/53956 | 12/1998 | (WO) | B24D/11/00 |

* cited by examiner

*Primary Examiner*—Michael Marcheschi
(74) *Attorney, Agent, or Firm*—Gregory D. Allen

(57) ABSTRACT

The present invention provides an improved nonwoven abrasive product. The improved abrasive product has a porous, lofty web of multiple layers of coiled, autogenously bonded thermoplastic filaments, binder resin, abrasive granules and size resin. When porous, lofty web, before adding binder resin, abrasive granules or size resin, has a coil weight in the range of 17 to 28 g/24 in$^2$ (1.097 to 1.808 kg/m$^2$) and is variegated, and the coated porous lofty web exhibits a relatively high measured load/deflection value then the useful life of the abrasive product is greatly increased compared to abrasive products made from webs having lower coil weights and no variegation.

22 Claims, 1 Drawing Sheet

DURABLE NONWOVEN ABRASIVE PRODUCT

REFERENCE TO CROSS-RELATED APPLICATIONS

This application is a continuation-in-part of U.S. application Ser. No. 09/401,938, filed Sep. 23, 1999, Abn which is a continuation-in-part of U.S. application Ser. No. 09/264,495, filed Mar. 8, 1999, Abn which is a continuation-in-part of U.S. application Ser. No. 09/231,263, filed Jan. 15, 1999, abandoned.

BACKGROUND

This invention provides a durable, nonwoven abrasive product having a significantly longer useful product life compared to conventional, but similar abrasive products.

Nonwoven, low-density abrasive products made of a uniform lofty web of continuous three-dimensionally bonded polyamide filaments, such as those abrasive products described in U.S. Pat. No. 4,227,350 (Fitzer), have found successful application for treating or conditioning various types of surfaces. These applications include, in part, removing mill scale from steel coil stock, blending of weld lines, preparing surfaces for painting or other coating operation, and removing various surface coatings in repair and maintenance operations. These successes have spurred the inevitable pursuit of providing increased value to the end user for such abrasive products and particularly for increased useable product life.

When current low-density abrasive products are used, for example in an automotive body repair shop, in the form of 4 to 6 inch (10.1 to 15.2 cm) diameter discs, these discs may encounter many sharp edges as the discs are used to clean or prepare automotive surfaces for coating, filling, welding, and other operations. Sharp edges include those associated with bent sheet metal, fasteners, fastener heads, rust-perforated sheet metal, and the like. While these types of surfaces are effectively cleaned or prepared by the low-density abrasive disc, cleaning and preparation operations around sharp edges exact a toll, causing the low-density abrasive product life (the time it takes to wear the abrasive product from its initial diameter to a diameter equal to that of its central attachment fixture) to be much shorter than desired. Under extreme conditions, the abrasive product life may be as short as one minute or less.

Related product life or product use life concerns also arise from the practice of abrading a workpiece by using the face of these discs, instead of by using the circumference of the disc. Invariably, methods using the face of these discs involve the flexing, bending, or otherwise exerting lateral forces on the abrasive disc, in some cases, to an extreme amount of flexing or bending.

SUMMARY OF THE INVENTION

The present invention provides an improved nonwoven abrasive product. The improved abrasive product has a porous, lofty web of multiple layers of coiled, autogenously bonded thermoplastic filaments, binder resin, abrasive granules and size resin, and typically exhibits product life of at least twice that of conventional, but similar, abrasive products. In one embodiment, the present invention provides a porous, lofty web that, before adding binder resin, abrasive granules or size resin, has a coil weight in the range of between 17 and 28 g/24 in$^2$ (1.097 and 1.808 kg/m$^2$) and preferably in the range of between 18 and 23 g/24 in$^2$ (1.162 and 1.486 kg/m$^2$).

In another embodiment, this invention provides a porous, lofty web that exhibits periodic coil density variations in the machine direction, referred to in this specification as "variegation", of a magnitude of between 10 and 20 mm.

In still another embodiment, this invention provides a porous, lofty web of multiple layers of coiled, autogenously bonded thermoplastic filaments, binder resin, abrasive granules and size resin, and exhibits a measured load at a 1.52 cm deflection (averaged values) of greater than 3.20 kg.

In other preferred embodiments of the claimed invention, the porous, lofty web has a uniform cross-section of at least one layer of filaments. Each layer of filaments includes a multitude of continuous three-dimensionally undulated filaments made of extruded thermoplastic material in which adjacent filaments are interengaged and autogenously bonded where they touch one another. These undulated filaments preferably are made of polyamide polymers and have diameters of about 5 to 125 mils (0.127 to 3.175 mm) and more preferably have diameters of about 14 to 20 mils (0.355 to 0.508 mm). When the porous, lofty web exhibits variegation, useful amounts of variegation include those having variegation periods (distance between density peaks) of between 10 and 20 mm. The porous, lofty web is impregnated or coated with a tough binder resin that both bonds a multitude of abrasive granules uniformly throughout the web and further bonds adjacent filaments to one another. In preferred embodiments an additional size resin is also impregnated or coated over the web, binder resin and abrasive granules to further bond the abrasive granules to the web.

DRAWINGS

The present invention is illustrated and described in FIGS. 1–5.

Figure 1:
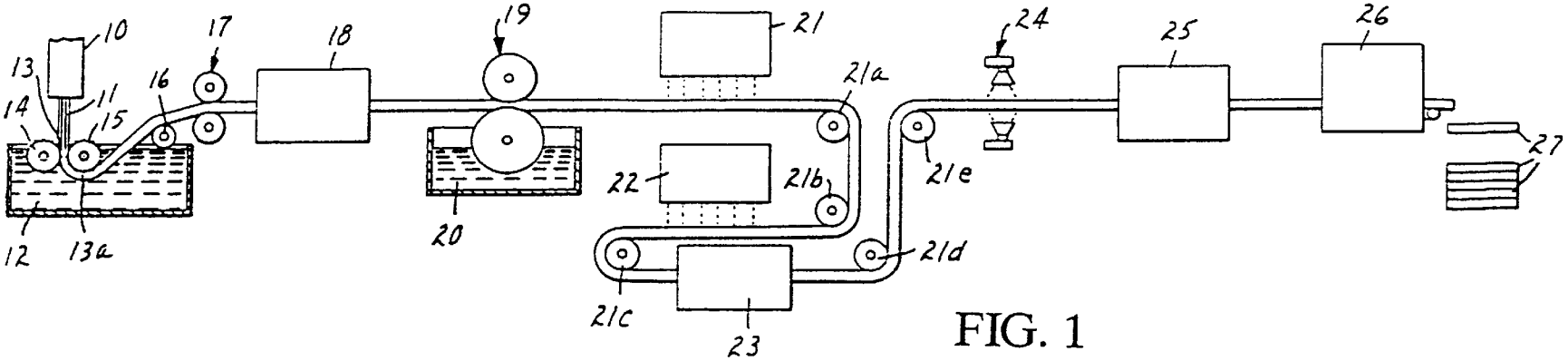
FIG. 1 is a schematic illustration of the process used to make an abrasive product of the present invention.

DETAILED DESCRIPTION number of approaches have been taken to provide a nonwoven, low-density abrasive product of superior useful product life. For example, attempts to use thermoplastic filaments other than polyamide filaments from which to make the lofty web have been unsuccessful. Attempts to produce a tougher, denser abrasive product by using finer filaments have resulted in process difficulties since the more numerous fine filaments cause a shadowing effect that results in insufficient resin and mineral penetration into the thickness of the lofty web. Still further attempts at using larger filament diameters have resulted in an abrasive product that has large voids in the lofty web due to higher amplitude oscillations of the molten filaments as they are integrated into a web.

According to the present invention, small increases in web and/or coating weights, along with a specific level of variegation in the web and a higher measured load/deflection value, result in dramatic increases in product life.

Variegation, or the occurrence of density variation in the machine direction, has long been considered a defect in the manufacture of low-density abrasive products made of a uniform lofty web of continuous three-dimensionally bonded filaments. Variegation is, at least in part, a function of extrusion rate, melt temperature, quench tank geometry, quench fluid temperature, or harmonic mechanical motions of rollers, that occur during manufacture. Under conventional or typical operating conditions, variegation is not visually detectable. Under conditions of high extrusion rates and line speeds, variegation becomes visually detectable, and was considered to yield an unacceptable web. This empirical observation has served to limit production speeds practicable to make such abrasive articles.

The bending stiffness of low-density abrasive products made of a uniform lofty web of continuous three-dimensionally bonded polyamide filaments, as determined by measuring a load at a 1.52 cm deflection, has been long considered to have a relatively low useful maximum value, typically less than 3.20 kg. This low maximum value has been maintained because of the undesired operating vibrational forces typically encountered when using such low-density abrasive articles having a measured load at a 1.52 cm deflection values of greater than 3.20 kg. However, in some applications, such as cleaning weld lines, the end user will employ such articles not as a wheel where the abrasion is induced at the circumference of the article, but instead as a disc, where the abrasion occurs on a face of the disc. Such uses when abrading a workpiece on the face of the disc impart substantial lateral forces on the abrasive article. In extreme cases, these types of uses may result in the article being flexed nearly 90° out-of-plane during each revolution, which causes heating of the article and a resultant shortening of useful product life.

The present invention advantageously exploits the unexpected understanding that increasing the coil weight of a low-density abrasive product significantly increases the useful abrasive product life. In some circumstances, the abrasive product life is more than doubled when compared to the product life of conventional low-density abrasive products. Useful exploitation is also made of the surprising discovery that variegation, or periodic density variation in the web along its machine direction of between 10 mm and 20 mm, actually increases overall web integrity, as exhibited by machine direction and cross direction tensile test results. Further, the present invention also provides a low-density abrasive product that has a significant increase in the useful abrasive product life when the measured load at a 1.52 cm deflection value is greater than 3.20 kg.

As used herein, "coil" refers to the web of undulated polymeric filaments prior to the application of any coatings or particles. "Variegation" refers to a sustained periodic variation of web (coil) density arising from manufacturing process conditions that is manifested as alternating higher and lower density "stripes" or "streaks" ("variegation pattern") traversing the web in the cross-machine direction, the periodicity appearing in the machine direction.

Processes used to prepare low-density abrasive products of the present invention are set out in U.S. Pat. No. 4,227,350, which is incorporated by reference in this application.

The abrasive product can be formed in a continuous process, if desired, virtually directly from the basic ingredients, i.e., from polyamide filament-forming material, liquid curable binder resin and abrasive granules. That is, the polyamide filament-forming material can be extruded directly into a lofty, open, porous, filament web. Abrasive granules, binder and size resins are then applied to the web to provide the finished abrasive product. In the web-making process employed in the present invention, polyamide filament-forming material is inserted into an extruder equipped with a spinneret head which has a multitude of openings equally spaced in at least one row, preferably in a plurality of spaced rows of equally spaced openings. The row or rows of molten filaments are then extruded downwardly, permitted to freely fall a short distance through an air space and then into a quench bath. As the filaments enter the quench bath, they begin to coil and undulate, thereby setting up a degree of resistance to the flow of the molten filaments, causing the molten filaments to oscillate just above the bath surface. The spacing of the extrusion openings from which the filaments are formed is such that, as the molten filaments coil and undulate at the bath surface, adjacent filaments touch one another. The coiling and undulating filaments are still sufficiently tacky as this occurs, and where the filaments touch, most adhere to one another to cause autogenous bonding to produce a lofty, open, porous filament web.

The web is then directed into the quench bath between opposed rollers positioned a distance below the surface of the quench bath where the filaments of the integrated mat will still be sufficiently plastic to be permanently deformed as they pass therebetween. These rolls are operated at the same speed but in opposite directions to draw the formed filament web away from the area where the filaments initially coil and bond together. The rolls are spaced to contact the surfaces of the web with slight pressure sufficient to smooth any uneven surface loops or undulations to provide a web with generally flat surfaces. The roller contact will not provide a higher density of filaments at either surface of the web. Instead, the web will have a defined thickness after being passed between the rollers. For this purpose, the surfaces of the rolls are preferably smooth to produce the generally flat surface. Since useful abrasive products may also have other than flat surfaces, the roll surfaces may have other configurations to provide an abrasive product with a modified surface. For example, a pleated surface roller will produce webs with a pleated surface. Alternatively, the roller surface may have spikes uniformly disposed on its surface to provide for more secure web handling. The rolls are operated at a surface speed substantially slower than the extrusion speed to permit sufficient time for the filaments to coil and undulate and form a lofty web with a high degree of undulation in each filament. This process produces a web wherein each filament is coiled and undulated throughout its length.

The undulations of each filament are typically irregular although it is possible to adjust the process to produce regular helically coiled filaments. Irregular filament undulation is characterized by random looping, kinking or bending of the filaments through the web in a pattern defined generally by the pattern of openings of the spinneret.

Figure 5:
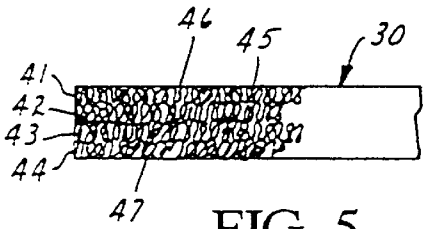
FIG. 5 is a cross sectional view of an abrasive product of this invention.

It should be noted that, where more than one row of filaments is extruded, a web is produced having layers of coiled and undulated filaments, each layer representing a row of extruded filaments. Each layer is discernible, sometimes with great difficulty, in the web. The adjacent filaments between layers will also be autogenously bonded together for the most part where they touch one another. This aspect of a multilayer web is shown in FIG. 5 which illustrates four rows 41, 42, 43 and 44 of undulated filaments 45. Note the outer rows 41 and 45, respectively, have substantially flat surfaces 46 and 47, respectively.

As illustrated in FIG. 1, polyamide filament-forming material is heated to a molten state and extruded from an extrusion spinneret 10 which contains at least one row of openings to provide a bundle of free-falling filaments 11. Filaments 11 are permitted to freely fall through an air space into a quench bath 12 where they coil and undulate at or near the surface of bath 12 to form an autogenously bonded web 13. While it is still sufficiently plastic to be permanently deformed, web 13 is then passed between opposed smooth-surfaced rollers 14 and 15 which may have a pattern of uniformly spaced spikes projecting from the roller surface which are positioned to provide a substantially flat-surfaced web. Web 13 is then drawn around one of the rollers, e.g., roller 15, for removal from quench bath 12. Web 13 is then passed over idler roll 16 between guide roll set 17 and dried in forced air oven 18 to remove residual quench liquid. The web is wound onto a roll and stored for about 4 weeks to allow morphological equilibration.

The web is then passed through roll coating station 19 where liquid curable binder resin 20 is applied to web 13. Other conventional web coating techniques may be employed to coat the web so long as such techniques provide a substantially uniform binder resin coating. For example, dip coating and spray-coating techniques may also be used. The binder resin coating should be sufficient to permit uniform coating of the web with abrasive granules. Thereafter, the wet coated web is passed beneath a first abrasive granule dropping station 21 to coat one side of the web with abrasive granules and deployed in an S-shaped arrangement around suitable idler rollers 21*a*, 21*b*, 21*c*, 21*d* and 21*e* to reverse the web surfaces (that is, face the bottom side up). The other surface of the web is then passed under a second abrasive granule depositing station 22 to provide a web, which has been coated on both web surfaces with abrasive granules. Other abrasive granule applications or coating devices may also be used; e.g., the abrasive granules may be applied by spray methods such as employed in sandblasting except with milder conditions, by electrostatic coating methods, and the like. The abrasive granule-coated web is then passed through forced air oven 23, to cure the first binder resin coating and then a second coating of a size resin is applied with a suitable device such as spray station 24 which simultaneously sprays top and bottom surfaces of the web with a quantity of size resin material which will bond the abrasive granules to the surface of the web. The quantity of the size resin coating should be limited so it will not cover or mask the abrasive granules. Once coated, the web is then passed through forced air oven 25, and finally into converting station 26 where it is cut into desired shapes 27.

Figure 3:
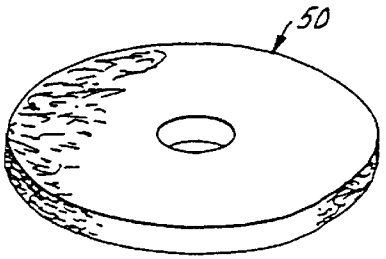
FIGS. 2–4 are perspective views that illustrate three embodiments of an abrasive product of the present invention.
Figure 4:
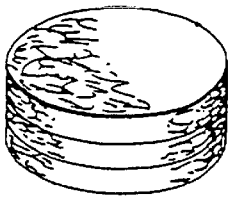
Figure 2:
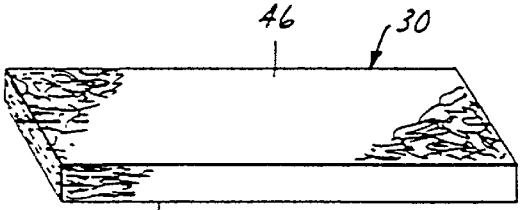

Typical shapes of the abrasive product of the invention include those depicted by FIGS. 2, 3 and 4. FIG. 2 shows a rectangular shape abrasive product 30 while FIG. 3 shows an annulus shape abrasive product 50. FIG. 4 shows yet another embodiment which is made by stacking several layers of the web after the second application of binder resin but prior to the second curing step, compressing the stack and curing to provide a relatively densified abrasive product which may be cut into any of a variety of shapes such as a cylinder.

The filament-forming material which is extruded to provide the lofty web contained in the low-density abrasive product of the invention is formed of a thermoplastic polyamide material which can be extruded through extrusion orifices to form filaments. Particularly useful polyamide materials for forming the filaments of the web of the abrasive product of this invention are polycaprolactam and poly(hexamethylene adipamide) (e.g., commonly referred to as nylon 6 and nylon 6,6). Other useful filament-forming materials may include polyolefins (e.g., polypropylene and polyethylene), polyesters (e.g., polyethylene terephthalate), polycarbonates and the like.

The webs produced by the process described above are particularly suited for abrasive products because they are extremely open, porous, and lofty which permits prolonged usage of the abrasive product for conditioning (for example, surfaces where large amounts of attrited matter are produced), without filling the web and thus interfering with the abrasive product's properties. The degree of openness and loftiness is evidenced by the web void volume which is typically at least about 80% (preferably about 85% to about 97%) in the uncoated state. Upon coating with the binder resin, the web also has a considerable degree of structural integrity that permits prolonged usage of the abrasive article. The flattening effect of the rollers provides a unique abrasive structure that is highly open at the surface yet has a flat face capable of use on flat surfaces without requiring bending or modification of the web. Additionally, the web, even with the binder resin coating and abrasive granules, is flexible and conformable and will typically conform to most surfaces upon which it is used.

The web may be made in a wide variety of thicknesses, limited principally by the design of the spinneret through which it is extruded and the gap between rollers 14 and 15 illustrated in FIG. 1. Typical web thicknesses useful for abrasive products will vary between ¼ inch to 3 inches (0.63 to 7.6 cm). The filament diameter of the filaments in the web produced by the process described above may be varied by modification of the web-making process. Typically, the filament diameter for a suitable web will be on the order of 5 to 125 mils (0.127 to 3.175 mm), but preferably is on the order of 14 to 20 mils (0.355 to 0.508 mm). Spinneret extrusion openings of 5 to 125 mils (0.127 to 3.175 mm) will produce such webs. The openings in the spinneret will be in rows, as previously stated, and separated by at least about 0.1 inch (2.54 mm) to produce satisfactory results. The openings of adjacent rows may be offset from one another although the spinneret performs suitably when the openings in the rows are aligned.

It should be noted that one does not necessarily obtain a filament in the quenched web that is identical to the diameter of the extrusion orifice from which it was extruded. There may be some thickening of the molten filament near the spinneret openings caused by surface tension, which would tend to increase the filament diameter. There may also be some decrease of the filament diameter caused by attenuation in the free fall zone between the spinneret and the quench bath surface, the attenuation increasing as the free fall height increases. The free fall height may vary between about 2 to 20 inches (5.08 to 50.8 cm) to produce a satisfactory product. Typically the free fall height will be on the order of from 5 to 15 inches (12.7 to 38.1 cm).

As web production rates are increased to yield more pounds per hour of web, a variegation pattern, or periodic sinusoidal density variation, appears in the web product. Variegation manifests itself as a density variation periodicity. The peak-to-peak spacing of this periodicity increases as the production rate increases. The frequency of the periodicity increases as the production rate is decreased. Variegation may be detected analytically, but at some minimum amplitude or some maximum frequency, this pattern may be detected visually as discernibly heavier streaks that traverse the web in a cross-machine direction.

It would generally be expected that the machine direction (the direction normal to that of the streaks) would exhibit a tensile strength of the web to be diminished to that of the lighter, lower-density areas. The contrary result, however, is observed. The machine direction tensile strength shows a notable increase compared to webs having no variegation.

There appears to be three distinct empirically observed regions in the production process that may be used to vary or control web variegation based on web production rates or line speed for a given desired web weight (e.g., 1.36 kg/m$^2$), with other variables of die design, extrusion temperatures, quench fluid, quench tank geometry, quench fluid temperature, design of web forwarding means, material, and additives, all remaining constant. The line speed is allowed to vary to produce the desired web weight. These three production process regions for the production of 1.36 kg/m$^2$ web are: 1) that of previous production rates of about 470 pounds per hour (214 kg/hr.), wherein the variegation period is less than 10 mm; 2) that of increased production rates of about 700 pounds per hour (318 kg/hr.), wherein the variegation period is between 10 and 20 mm; and 3) that of very high extruder output rates of greater than about 700 pounds per hour (318 kg/hr.), wherein the variegation period becomes excessive, i.e., greater than 20 mm. It is the second region that is the most beneficial in which to operate to produce 1.36 kg/m$^2$ web.

Among the possible interactions that result in variegation are harmonic distortions due to local boiling of the quench fluid (and are therefore influenced by extruder output, extrusion die design, extrusion temperatures, quench conditions, and materials and additives), motion-induced standing waves in the quench tank (that are therefore dependent, at least in part, on the design and dimensions of the quench tank), asynchronous operation of the various rollers that contact the web, and/or a combination of the above. There may be yet other interactions that cause or at least contribute to these density variations under certain operating conditions.

In order to realize the long-life characteristics of the present invention, the resultant web or coiled substrate weight should weigh between 17 and 28 g/24 in$^2$ (between 1.097 and 1.808 kg/m$^2$) and preferably should weigh between 18 and 23 g/24 in$^2$ (1.162 and 1.486 kg/m$^2$). Lesser weights do not provide the increased useable life of the resulting abrasive product. Heavier web weights result in a product that is insufficiently compliant to smoothly run against a typical workpiece. For longest end-product life, variegation is present. The preferred period of variegation is between 10 and 20 mm (peak-to-peak). The widths in the machine direction of the higher density variegated areas are typically about 5 to 10 mm.

The preferred binder resin employed in the production of the present abrasive products has a liquid state to provide a coatable composition, yet it can be cured to form a tough, adherent material capable of adherently bonding the abrasive granules to the web even under aggressive use conditions. Preferably, when cured the binder resin will have a tensile strength of at least 3000 psi ($2.06\times10^4$ kPa) and an ultimate elongation of at least 180% and a Shore D hardness of at least 40. The presently preferred resin binder material is a polyurethane which may be prepared from commercially available isocyanate prepolymeric materials such as materials sold under the trade designation ADIPRENE L type, for example, L-83, L-100, L-167, and L-315 (commercially available from Crompton & Knowles Corporation, Stamford, Conn.), which may be cured with, for example, p, p'-methylene dianiline (MDA). The reactive isocyanate groups of these materials may be blocked with blocking agents such as ketoxime or phenol to give a liquid material that may be cured with MDA. These materials cure with heating in the temperature range of 104° to 160° C. to produce cured binder resin having the requisite physical properties, yet they are initially liquid and have sufficient pot life to use in the present process to produce useable abrasive products. The uncured, unblocked prepolymeric materials will have a nominal NCO content of from about 3% to 10%, a nominal viscosity at 30° C. of about 6000 to 30,000 cps and a specific gravity of about 1.03 to 1.15 at 25° C. The quantity of binder resin is sufficient to adherently bond the abrasive granules throughout the web to provide a long-lifted abrasive product yet is limited so that it will not cover or mask the abrasive granules themselves. Thus, as the size of the abrasive granules varies, some modification may be required in the amount of binder resin used. For example, smaller abrasive granules may require less binder resin. Besides binding the abrasive granules to the surfaces of the filaments of the web, the binder resin also provides for additional filament to filament bonding in the web itself. While these filaments have been autogenously bonded together during the web forming operation, they may still be separated, especially if large mechanical forces are applied to the abrasive product. For abrasive products of the present invention having surprisingly longer useful life, however, the binder resin should be applied in an amount between 4.8 to 16.2 (dry) g/24 in$^2$ (0.310 to 1.050 kg/m$^2$). A lesser amount of binder resin will not provide the long life. Heavier coatings will cause the abrasive product to be too stiff for use in some applications causing vibrations during operation. Problematic "smearing", or transfer of binder resin to the surface of the workpiece, will also be more likely at higher coating weights. Suitable abrasive granules may be any known abrasive particles or materials commonly used in the abrasive articles. The abrasive granule size may vary from 10 grit to 600 grit (average diameter 2 to 0.01 mm) and the minerals forming the abrasive granules may vary in Mohs hardness from 4 to 10. Examples of minerals that provide useful abrasive granules include pumice, topaz, garnet, alumina, corundum, silicon carbide, zirconia, ceramic aluminum oxide, and diamond. Agglomerated granules of abrasive particles and a binder may also be useful. Even other organic particles, such as comminuted nut shells and ground thermoplastic or thermosetting polymer particles may also be useful, especially where relatively soft workpieces and/or coatings are treated or conditioned. The abrasive product may also contain mixtures of several granule sizes, different abrasive materials uniformly incorporated therein or different abrasive sizes, hardnesses or materials on either surface. It will be readily apparent in view of the present invention to modify the abrasive product for a particular application by selecting the appropriate abrasive material. The abrasive product of the present invention may be modified in other ways without departing from the scope of the claims. For example, commonly known additive materials may be employed in the resin binder coating such as metal working lubricants (e.g., greases, oils, and metal stearates). Such additives are typically added during the second binder coating operation so as not to interfere with granule adhesion to the filaments.

In order to realize the extended product life of the present invention, abrasive granules should be applied in an amount between 32.4 and 97.4 g/24 in$^2$ (2.092 and 6.280 kg/m$^2$).

In order to further anchor the abrasive granules to the web, a second, or "size" coating of resin may be applied to the abrasive product. Size resins suitable for these size coatings are constitutionally the same as those used for the initial coating, and are applied and hardened in the same manner. Preferred coating weights for size resins are between 6.2 to 18.2 g/24 in$^2$ (0.400 to 1.170 kg/m$^2$).

Abrasive products of the present invention will have a total weight, including all coatings, of between 60.4 to 159.8 g/24 in$^2$ (3.9 to 10.4 kg/m$^2$).

Abrasive products of the present invention will exhibit variegation with a period of 10 to 20 mm, that is, with high-density peaks appearing 10 to 20 mm apart. This level of variegation in an abrasive product is likely indiscernible to the eye, but is readily detected by instrumental methods.

The abrasive products of the present invention may be in any of a variety of shapes as typically encountered for nonwoven abrasive products. For example, suitable shapes in both rectangular pads or disc-shaped pads which may have a central opening for attachment of an arbor for rotation. Alternatively, they may be cut into shapes such as rectangular shapes and mounted about the periphery of a rotatable hub to provide a flap wheel. Other shapes are also contemplated. During converting steps, no particular care is taken to either include or avoid any particular variegation pattern, number or variegation periods. The abrasive product of this invention may be laminated to other layers to provide a modified abrasive article. For example, the abrasive product may be laminated to a foam or sponge layer to provide dual cleaning functions or to provide a cushioning layer. Any of a variety of mounting devices or handles may also be applied to the abrasive product to provide an implement that may have a removable or permanently attached handle.

The abrasive products of the present invention are aggressive treating or conditioning implements that may be utilized in any of a variety of situations. They are much more open than most commercially available nonwoven abrasive products and thus resist loading with swarf or other residual materials produced in use. They can thus be used for much longer periods of time than conventional nonwoven abrasive products. For example, these abrasive products will remove thick, hard, tough coatings of reflective sheeting material from road signs and will remove tempering or heat-treating oxides from metal surfaces. The abrasive products of the invention have an optimum balance of filament strength, resin strength and abrasive mineral adhesion to have an attrition rate such that fresh abrasive mineral particles are constantly being exposed so that the product performs consistently throughout its entire life. The abrasive products of the invention have been found to perform in a superior manner to conventional nonwoven abrasive products in the following situations such as removing paint from metal and wood surfaces, removing heat-treating and tempering oxides from wire rod and circular saw blades, removing thick protective grease coatings and oxide coatings from boiler heat exchange tubes prior to welding, removing rust, dirt and contamination from steel coil during reclaiming operations, removing reflective sheeting materials from highway signs during reclaiming operations, removing slag and oxide from the surface of welded parts, and removing the protective paper coating and hard plastic coatings during the reclamation of plastic sheets such as those formed of LEXAN polymer. These abrasive products also produce decorative finishes on metal parts such as stainless steel tubing and sheeting.

The present invention is further illustrated by the following nonlimiting examples, wherein all parts are by weight unless otherwise specified.

TEST METHODS

Wear Test

The examples according to the present invention were evaluated for performance by using a wear test. The wear test rotated a disc shaped sample of the present abrasive product against a 304 stainless steel screen coupon for a period of four minutes. The screen coupon consisted of a 1.90 mm thick stainless steel sheet having a hexagonal close packed array of 7.92 mm diameter holes disposed 1.25 cm (center to center) apart. The abrasive discs evaluated consisted of 21.5 cm diameter disc of abrasive product which was compressed between 7.6 cm diameter holding flanges to produce a cylindrical abrasive surface. The compressed disc was rotated on a rotating shaft at a rate of 2500 rpm with a force of 6.8 kg between it and the screen coupon. As the disc was rotated, the screen coupon was oscillated in a linear direction along the array of holes, the array of holes being moved in 12 second cycles 13.9 cm lengthwise. One disc was tested for each evaluation. In the wear test, the total weight of the coupon was measured before and after the test to determine the amount of material cut or removed (reported in the table in grams as "cut") from the screen coupon to give an indication of the relative cutting ability of the abrasive product. A preferred abrasive product of the invention will have a cut of at least 5 grams for the test identified above. The weight loss of the abrasive disc was also determined and is also reported in Tables 3, 5 and 6 as Disc Loss (g) (weight loss of material during testing measured in grams). The weight loss for a preferred abrasive product of this invention will be less than 40 grams.

Variegation Test

Uncoated web test specimens were cut to dimensions of approximately 4"×6" (10 cm×15 cm) and placed on a black pad to maximize contrast. A video apparatus consisting of a video microscope (INFINIVAR, available from Infinity Photo-Optical Company, Boulder, Colo.), a CCD camera (model 4810, available from Cohu, Incorporated, Electronics Division, San Diego, Calif.), and a video display device was aimed at the specimen and positioned so that the displayed field of view was about the size of the specimen. Side incident illumination was adjusted to obtain the best image contrast for elucidating the variegation structure in the webs. NIH IMAGE software (available from the National Institutes of Health, Washington, D.C.) operating in conjunction with a frame grabber QUICKCAPTURE (Data Translation, Incorporated, Marlboro, Mass.), both running on a Macintosh "Power Mac 8100/100" computer were used to acquire the images from a selected area of the displayed image. An image of a ruler was taken separately, but under identical conditions, for calibrating the images. The images were exported to a MATHCAD (Mathsoft, Inc., Cambridge, Mass.) software routine. The routine produces intensity profile (proportional to fiber density) along the machine direction from each image. The first derivative of the data was generated from the profile, and the period of the variegation was calculated from the first derivative graph as the distance between adjacent positive peaks. Various regions in the images were analyzed to give mean values and standard deviation of the variegation period.

Load/Deflection Test

Samples 2.0×7.0×0.5 inch (5.1×17.8×1.27 cm) were cut from each of the materials tested, in both the machine direction and cross direction of the web. Three to five samples were tested using a three point bend fixture on a SINTECH (MTS Systems Corporation, Eden Prairie, Minn.) load frame using ASTM Standard test method D790. The samples were supported between two 1.000 inch (2.54 cm) radius supports spaced 6.0 inches (15.2 cm) apart and deflected 1.000 inch (2.54 cm) at a strain rate of 10 inches/min (25.4 cm/min) using a loading nose of radius 0.50 inch (1.27 cm). This rapid strain rate exceeds that specified by ASTM D790, but more closely approximates the stresses experienced in the application of the material. The data was acquired and analyzed using a computerized data system. Measured load/deflection values were recorded. The average load at 0.60 inch (1.524 cm) deflection for each example is reported in Table 6.

Abrasive Product Preparation

Examples L1–L8 and Control

Preparing Nonwoven Webs

A continuous filament nonwoven web was made similarly to that of Example 1 of U.S. Pat. No. 4,227,350. Polycaprolactam polymer (nylon 6, available commercially under the trade designation ULTRAMID B3 from BASF Corporation, Polymers Division of Mt. Olive, N.J.) was extruded at a pressure of 2800 psi ($1.93\times10^4$ kPa) through a 60-inch long (1.52 meter) spinneret having about 2890 counter sunk, counter bored openings arranged in eight equal rows spaced 0.080 inch (0.2 cm) apart in a hexagonal close packed array, each opening having a diameter of 0.016 inch (0.406 mm) and having a land length of 0.079 inch (2.01 mm). The spinneret was heated to about 248° C. and positioned about 12 inches (30.48 cm) above the surface of a quench bath which was continuously filled and flushed with tap water at the rate of about 0.5 gallon per minute (about 2 liters/minute). Filaments extruded from the spinneret were permitted to fall into the quench bath where they undulated and coiled between 4 inch (10.16 cm) diameter, 60 inch (1.52 m) long smooth-surfaced rolls. Both rolls were positioned in the bath with their axes of rotation about 2 inches (5.1 cm) below the surface of the bath, and the rolls were rotated in opposite directions at a rate of about 9 feet/minute (2.74 m/minute) surface speed. The rolls were spaced to lightly compress the surfaces of the resultant extruded web, providing a flattened but not densified surface on both sides. The polymer was extruded at a rate of about 700 lb./hr. (318 kg/hr.), producing a 59 inches wide, 0.66 inch thick (1.50 m wide ×16.8 mm thick) web having 8 rows of coiled, undulated filaments. The resulting web weighed about 20.99 g/24 $in^2$ (1.356 $kg/m^2$) and had a void volume of about 92.6%. The filament diameter averaged between 16 to 18 mils (0.406 to 0.457 mm). The web was carried from the quench bath around one of the rolls and excess water was removed from the web by drying with a room temperature (about 23° C.) air blast. Web weights and filament diameters were varied by the adjustment of roll speed, air space for filament free-fall, and extruder output to produce the examples.

The dried web thus formed was later converted to an abrasive composition by applying a binder resin coating, mineral coating, and size coating. The binder resin coating contained the ingredient shown in Table 1 and was applied via a 2-roll coater. Following the application of the binder resin coating to achieve about 7.78 g/24 $in^2$ (0.503 $kg/m^2$) dry add-on, grade 36 SiC abrasive granules were then applied to the resin coated web via a drop coater. The web was agitated to encourage penetration of the granules into the interstitial spaces of the web. 2.6 $kg/m^2$ of abrasive granules were applied to the web. The composition was then heated in an oven for 6 minutes at 160° C. Coating conditions were varied to produce the various dry make and mineral coatings.

TABLE 1

| Component | Parts |
|---|---|
| Ketoxime-blocked poly(1,4-butylene glycol diisocyanate)[1] | 45.6 |
| Methylene dianiline solution[2] | 15.7 |
| Glycidoxypropyltrimethoxy silane[3] | 0.8 |
| xylol solvent | 34.8 |
| fumed silica[4] | 3.1 |

[1]polydiisocyanate having a molecular weight of about 1500 commercially available under the trade designation "ADIPRENE" BL-16 from Crompton & Knowles Corporation, Stamford, CT

[2]a curative solution of 35 parts p,p'-methylene dianiline and 65 parts ethylene glycol monoethyl ether acetate.

[3]silane coupling agent, available as "Z-6040" from Dow Corning Corporation, Midland, MI.

[4]viscosity modified, available as "'Cab-O-Sil" from Cabot Corporation, Cab-O-Sil Division, Tuscola, Illinois.

A size coating of the composition shown in Table 2 was then sprayed on the top side of the composition and heated in an oven for 6 minutes at 160° C. The composition was inverted and the other side sprayed with an identical amount of the size coating and heated in an oven for 6 minutes at 160° C. The final size coating dry add-on was about 7.78 g/24 $in^2$ (0.503 $kg/m^2$). The resulting compositions were then converted into discs for wear testing.

TABLE 2

| Component | Parts |
|---|---|
| Diisocyanate-functional urethane prepolymer[5] | 58.8 |
| Methylene dianiline solution[6] | 25.3 |
| Glycidoxypropyltrimethoxy silane[7] | 0.9 |
| xylol solvent | 12.9 |
| lithium stearate powder lubricant | 2.1 |

[5]diisocyanate-functional urethane prepolymer blocked by adding 14.8% 2-butanone oxime and 11.1% 2-ethoxyethanol acetate, commercially available under the trade designation "ADIPRENE" BL-31 from Crompton & Knowles Corporation, Stamford, CT.

[6]a curative solution of 35 parts p,p'-methylene dianiline and 65 parts ethylene glycol monoethyl ether acetate.

[7]silane coupling agent, available as "Z-6040" from Dow Corning Corporation, MIdland, MI.

Test Results

The data shown in Table 3 indicate that Lots 3, 4, 5, and 6, as well as the control lot demonstrated the most pronounced wear (i.e., at coil weights 1.20 $kg/m^2$ and less). At higher coil weights, the useful life of abrasive articles comprising same was dramatically increased.

TABLE 3

| Example | Coil weight, $kg/m^2$ | Filament Diameter, mm | Dry Make, $kg/m^2$ | Mineral, $kg/m^2$ | Mineral Penetration | Cut (g) | Disc Loss (g) |
|---|---|---|---|---|---|---|---|
| L1 | 1.18 | 0.39 | 0.66 | 2.48 | good | 6.62 | 8.40 |
| L2 | 1.22 | 0.37 | 0.64 | 2.48 | fair | 11.21 | 49.40 |
| L3 | 1.15 | 0.34 | 0.66 | 2.42 | fair | 9.05 | 111.2** |
| L4 | 1.20 | 0.30 | 0.74 | 2.34 | poor | 10.89 | 121.10 |
| L5 | 1.02 | 0.31 | 0.56 | 2.43 | fair | 9.66 | 99.3** |
| L6 | 1.01 | 0.34 | 0.52 | 2.49 | good | 8.10 | 110** |
| L7 | 1.36 | 0.41 | 0.84 | 2.34 | good | 5.69 | 7.10 |

TABLE 3-continued

| Example | Coil weight, kg/m$^2$ | Filament Diameter, mm | Dry Make, kg/m$^2$ | Mineral, kg/m$^2$ | Mineral Penetration | Cut (g) | Disc Loss (g) |
|---|---|---|---|---|---|---|---|
| L8 | 1.44 | 0.47 | 0.86 | 2.46 | fair | 5.79 | 9.10 |
| Control | 0.97 | 0.38 | 0.47 | 2.57 | good | 8.81 | 93.9** |

**Test specimen only ran 2.3 to 3.0 minutes before disc was worn to the holding flanges.

Examples L9–L12

Variegation Effects

The webs of Examples L9–L11 were made identically to those of Examples L1 through L8, with the exception that the output and line speed were varied to produce exemplary amounts of variegation in the various webs and that the quench bath was flushed with tap water at a rate of about 10 gallons/minute (about 40 liters/minute). The webs of Examples L12 and Control were made identically to those of L1 through L8, with the exception that the output and line speed were varied to produce exemplary amounts of variegation in the various webs. By varying only these parameters, variegation levels were made from nil to extreme, the latter (Example L12) having density extremes varying from 0.05268 g/cm$^3$ to 0.01611 g/cm$^3$, with the average Example L12 density being 0.0441 g/cm$^3$. Tensile strength was measured according to ASTM D 1682, conditions 2C-T, and the values are reported in Table 4. Variegation levels were measured according to the Variegation Test. The widths of visually distinct high-density regions were measured. The webs of Examples L9 and L11, showing advantageous variegation and nil variegation, respectively, were converted into abrasive disc products as in Examples L1–L8. The coating weights are shown in Table 5. Abrasive discs were then tested according to the Wear Test, and the results reported in Table 5. The data show that the better abrasive discs are made from webs having an intermediate level of variegation.

Examples L13–L16 and Comparative Example A—Load/Deflection Values

The webs of Examples L13 through L16 and Comparative Example A were prepared identically to those of Examples L1–L8, with the exception that the weights of the various coatings were varied as shown in Table 6 and that for webs of Examples L13 through L16 the quench bath was flushed with tap water at a rate of about 10 gallons/minute (about 40 liters/minute). Comparative Example A was made according to Example 9 of U.S. Pat. No. 4,227,350. The resulting webs were tested according to the Load/Deflection Test and the measured load at a 1.52 cm deflection values are reported in Table 6, showing that average load at a 1.52 cm deflection values greater than 3.20 kg were obtained for the higher various coating weights employed in Examples L13–L16. Abrasive articles, such as discs, made from such webs with high average measured load/deflection values exhibit surprising use life increases when operated such that lateral forces are imparted (i.e., the abrasive articles are deflected out-of-plane during operation) to the abrasive disc.

TABLE 4

| Lot | Average Weight, g/24 in$^2$ (kg/m$^2$) | Average Thickness, mils (mm) | Average Filament Diameter, mils (mm) | Average MD Tensile, lbs/2 inches width (kg/cm) | Average CD Tensile, lbs/2 inches width (kg/cm) | Variegation Period, mm | Width of dense regions, mm |
|---|---|---|---|---|---|---|---|
| L9 | 22.3 (1.440) | 697 (17.7) | 17.5 (0.44) | 17.6 (1.57) | 28.0 (2.50) | 12.8 | 5–9 |
| L10 | 23.6 (1.524) | 685 (17.4) | 18.0 (0.46) | 19.7 (1.76) | 32.5 (2.88) | 15.0 | 7–10 |
| L11 | 21.1 (1.363) | 666 (16.9) | 17.0 (0.43) | 15.8 (1.41) | 16.0 (1.43) | 7.5 | 3–5 |
| L12 | 17.2 (1.111) | 625 (15.9) | — | 16.2 (1.45) | 22.4 (2.00) | 24 | 10–12 |

TABLE 5

| Lot | Extrusion Rate, lbs/hr (kg/hr) | Dry Make weight, grains/24 in$^2$ (kg/m$^2$) | Mineral Weight, grains/24 in$^2$ (kg/m$^2$) | Dry Size Weight, grains/24 in$^2$ (kg/m$^2$) | Cut, grams | Disc Loss, grams |
|---|---|---|---|---|---|---|
| L9 | 699.1 (318) | 113 (0.473) | 494 (2.082) | 97 (0.406) | 8.7 | 24.0 |
| L11 | 466.0 (212) | 97 (0.406) | 617 (2.585) | 102 (0.427) | 9.7 | 68.2 |

TABLE 6

| Example | Coil weight, (kg/m$^2$) | Filament Diameter, (mm) | Dry Make, (kg/m$^2$) | Mineral, (kg/m$^2$) | Dry Size, (kg/m$^2$) | Cut (g) | Disc Loss (g) | Load at 0.60 inch (1.5 cm) deflection, lb (kg) |
|---|---|---|---|---|---|---|---|---|
| L13 | 1.36 | 0.43 | 0.54 | 2.85 | 0.62 | 8.4 | 21.0 | 9.19 (4.17) |
| L14 | 1.36 | 0.43 | 0.98 | 2.76 | 0.62 | 6.0 | 5.9 | 15.73 (7.14) |

TABLE 6-continued

| Example | Coil weight, (kg/m$^2$) | Filament Diameter, (mm) | Dry Make, (kg/m$^2$) | Mineral, (kg/m$^2$) | Dry Size, (kg/m$^2$) | Cut (g) | Disc Loss (g) | Load at 0.60 inch (1.5 cm) deflection, lb (kg) |
|---|---|---|---|---|---|---|---|---|
| L15 | 1.36 | 0.43 | 0.51 | 4.74 | 0.62 | 6.6 | 8.7 | 16.66 (7.56) |
| L16 | 1.36 | 0.43 | 0.54 | 2.60 | 1.25 | 5.0 | 4.3 | 15.70 (7.13) |
| Comparative A | 1.06 | 0.42 | 0.31 | 2.71 | 0.68 | 10.15 | 40.4 | 7.04 (3.20) |
| Control | 0.97 | 0.38 | 0.47 | 2.57 | 0.50 | 8.81 | 93.9** | 3.94 (1.79) |

**Test specimen only ran 2.3 to 3.0 minutes before disc was worn to the holding flanges

What is claimed is:

1. An abrasive product comprising a porous, lofty web of multiple layers of coiled, autogenously bonded polyamide continuous filaments having a coil weight of 17 to 28 grams/24 in$^2$, a binder resin, abrasive granules and a size resin, wherein the continuous filaments have a diameter of 14 to 20 mils.

2. The abrasive product of claim 1 wherein the continuous filaments are extruded thermoplastic polyamide material.

3. The abrasive product of claim 1 wherein the web is coated with a binder resin in an amount of 4.8 to 16.2 grams/24 in$^2$.

4. The abrasive product of claim 1 wherein the web is coated with a size resin in an amount of 6.2 to 18.2 grams/24 in$^2$.

5. The abrasive product of claim 1 wherein the web has a period of variegation of 10 to 20 mm.

6. The abrasive product of claim 1 wherein the product has a measured load at a 1.52 cm deflection of greater than 3.20 kg.

7. The abrasive product of claim 1 wherein the web is coated with abrasive granules in the amount of 32.4 to 97.40 grams/24 in$^2$.

8. An abrasive product comprising an open, porous lofty web having a coil weight of 17 to 28 grams/24 in$^2$ comprised of a multitude of continuous three-dimensionally undulated filaments having a diameter of 14 to 20 mils formed from an organic thermoplastic material with adjacent filaments being interengaged and autogenously bonded where they touch one another and a multitude of abrasive granules dispersed throughout and adherently bonded to the filaments of said web by a tough adherent binder.

9. An abrasive product comprising a variegated, porous, lofty web having a coil weight of 17 to 28 grams/24 in$^2$ comprised of multiple layers of coiled, autogenously bonded continuous polyamide filaments having a period of variegation of 10 to 20 mm, a binder resin, abrasive granules and a size resin, wherein the continuous polyamide filaments have a diameter of 14 to 20 mils.

10. The abrasive product of claim 9 wherein the continuous filaments are extruded thermoplastic polyamide material.

11. The abrasive product of claim 9 wherein the web is coated with a binder resin in an amount of 4.8 to 16.2 grams/24 in$^2$.

12. The abrasive product of claim 9 wherein the web is coated with a size resin in an amount of 6.2 to 18.2 grams/24 in$^2$.

13. The abrasive product of claim 9 wherein the product has a measured load at a 1.52 cm deflection of greater than 3.20 kg.

14. The abrasive product of claim 9 wherein the web is coated with abrasive granules in the amount of 32.4 to 97.40 grams/24 in$^2$.

15. An abrasive product comprising a variegated, open, porous lofty web having a coil weight of 17 to 28 grams/24 in$^2$ and a period of variegation of 10 to 20 mm comprised of a multitude of continuous three-dimensionally undulated filaments having a diameter of 14 to 20 mils formed from an organic thermoplastic material with adjacent filaments being interengaged and autogenously bonded where they touch one another and a multitude of abrasive granules dispersed throughout and adherently bonded to the filaments of said web by a tough adherent binder.

16. An abrasive product comprising a porous, lofty web having a coil weight of 17 to 28 grams/24 in$^2$ comprised of multiple layers of coiled, autogenously bonded continuous polyamide filaments, a binder resin, abrasive granules and a size resin wherein the product has a measured load at a 1.52 cm deflection greater than 3.20 kg, and wherein the continuous filaments have a diameter of 14 to 20 mils.

17. The abrasive product of claim 16 wherein the continuous filaments are extruded thermoplastic polyamide material.

18. The abrasive product of claim 16 wherein the web is coated with a binder resin in an amount of 4.8 to 16.2 grams/24 in$^2$.

19. The abrasive product of claim 16 wherein the web is coated with a size resin in an amount of 6.2 to 18.2 grams/24 in$^2$.

20. The abrasive product of claim 16 wherein the web has a period of variegation of 10 to 20 mm.

21. The abrasive product of claim 16 wherein the web is coated with abrasive granules in the amount of 32.4 to 97.40 grams/24 in$^2$.

22. An abrasive product comprising an open, porous lofty web having a coil weight of 17 to 28 grams/24 in$^2$comprised of a multitude of continuous three-dimensionally undulated filaments having a diameter of 14 to 20 mils formed from an organic thermoplastic material with adjacent filaments being interengaged and autogenously bonded where they touch one another and a multitude of abrasive granules dispersed throughout and adherently bonded to the filaments of said web by a tough adherent binder wherein the product has a measured load at a 1.52 cm deflection greater than 3.20 kg.

* * * * *

UNITED STATES PATENT AND TRADEMARK OFFICE

CERTIFICATE OF CORRECTION

PATENT NO. : 6,302,930 B1
DATED : October 16, 2001
INVENTOR(S) : Lux, Ronald E.

It is certified that error appears in the above-identified patent and that said Letters Patent is hereby corrected as shown below:

Column 2,
Line 46, insert -- A -- preceding "number";

Column 8,
Line 6, "lifted" should read -- lifed --;

Column 11,
Line 2, "Control" should read -- Control: --;

Column 12,
Line 15, "modified" should read -- modifier --; and
Line 42, "Mldland" should read -- Midland --.

Signed and Sealed this

Fourteenth Day of January, 2003

JAMES E. ROGAN
*Director of the United States Patent and Trademark Office*